US011814701B2

(12) United States Patent
Vo et al.

(10) Patent No.: US 11,814,701 B2
(45) Date of Patent: Nov. 14, 2023

(54) HIGH-PERFORMANCE 5000-SERIES ALUMINUM ALLOYS

(71) Applicant: NanoAL LLC, Ashland, MA (US)

(72) Inventors: Nhon Q. Vo, Winchester, MA (US); Francisco U. Flores, Lowell, MA (US); Davaadorj Bayansan, Glenview, IL (US); Evander Ramos, Los Angeles, CA (US)

(73) Assignee: NanoAL LLC, Ashland, MA (US)

( * ) Notice: Subject to any disclaimer, the term of this patent is extended or adjusted under 35 U.S.C. 154(b) by 732 days.

(21) Appl. No.: 16/562,981

(22) Filed: Sep. 6, 2019

(65) Prior Publication Data

US 2019/0390306 A1 Dec. 26, 2019

Related U.S. Application Data

(63) Continuation of application No. PCT/US2018/020899, filed on Mar. 5, 2018.

(60) Provisional application No. 62/468,467, filed on Mar. 8, 2017.

(51) Int. Cl.

| | |
|---|---|
| ***C22C 21/08*** | (2006.01) |
| ***B65D 1/12*** | (2006.01) |
| ***C22F 1/047*** | (2006.01) |

(52) U.S. Cl.

CPC ..... *C22C 21/08* (2013.01); *B65D 1/12* (2013.01); *C22F 1/047* (2013.01)

(58) Field of Classification Search

CPC ..... C22C 21/08; B65D 1/12; C22F 1/047

See application file for complete search history.

(56) References Cited

U.S. PATENT DOCUMENTS

| | | | |
|---|---|---|---|
| 3,551,143 | A | 12/1970 | Marukawa et al. |
| 3,807,969 | A | 4/1974 | Schoerner et al. |
| 5,087,301 | A | 2/1992 | Angers et al. |
| 5,327,955 | A | 7/1994 | Easwaran |
| 5,449,421 | A | 9/1995 | Hamajima et al. |
| 5,908,518 | A | 6/1999 | Hoffmann et al. |
| 5,976,214 | A | 11/1999 | Kondoh et al. |
| 6,149,737 | A | 11/2000 | Hattori et al. |
| 6,592,687 | B1 | 7/2003 | Lee et al. |
| 6,918,970 | B2 | 7/2005 | Lee et al. |
| 8,323,373 | B2 | 12/2012 | Haynes, III et al. |
| 8,778,099 | B2 | 7/2014 | Pandey |
| 9,453,272 | B2 | 9/2016 | Vo et al. |
| 10,697,046 | B2 | 6/2020 | Sanaty-Zadeh et al. |
| 2001/0025675 | A1 | 10/2001 | Haszler et al. |
| 2003/0192627 | A1 | 10/2003 | Lee et al. |

(Continued)

FOREIGN PATENT DOCUMENTS

| | | | |
|---|---|---|---|
| CN | 1555423 | A | 12/2004 |
| CN | 101649405 | A | 2/2010 |

(Continued)

OTHER PUBLICATIONS

Non-Final Office Action dated Jun. 26, 2020 for U.S. Appl. No. 15/263,011, 7 pages.

(Continued)

*Primary Examiner* — Anthony M Liang
*Assistant Examiner* — Danny N Kang
(74) *Attorney, Agent, or Firm* — Cooley LLP

(57) ABSTRACT

Aluminum-magnesium-manganese-zirconium-inoculant alloys that exhibit high strength, good ductility, high creep resistance, high thermal stability and durability.

17 Claims, 5 Drawing Sheets

(56) References Cited

U.S. PATENT DOCUMENTS

| | | | |
|---|---|---|---|
| 2004/0091386 | A1 | 5/2004 | Carroll et al. |
| 2004/0177902 | A1 | 9/2004 | Mergen et al. |
| 2004/0256036 | A1 | 12/2004 | Van Der Hoeven et al. |
| 2004/0261922 | A1 | 12/2004 | Van Der Hoeven et al. |
| 2009/0263275 | A1 | 10/2009 | Pandey |
| 2010/0143177 | A1 | 6/2010 | Pandey et al. |
| 2011/0017359 | A1 | 1/2011 | Pandey |
| 2012/0000578 | A1 | 1/2012 | Wang et al. |
| 2013/0183189 | A1 | 7/2013 | Bishop et al. |
| 2013/0199680 | A1 | 8/2013 | Apelian et al. |
| 2013/0220497 | A1 | 8/2013 | Huskamp et al. |
| 2015/0259773 | A1 | 9/2015 | Vo et al. |
| 2015/0284825 | A1 | 10/2015 | Norman et al. |
| 2015/0284831 | A1 | 10/2015 | Kropfl et al. |
| 2016/0271688 | A1 | 9/2016 | Wuest et al. |
| 2017/0058386 | A1 | 3/2017 | Vo et al. |
| 2018/0010215 | A1 | 1/2018 | Sanaty-Zadeh et al. |

FOREIGN PATENT DOCUMENTS

| | | | |
|---|---|---|---|
| CN | 103233147 | A | 8/2013 |
| CN | 103866167 | A | 6/2014 |
| CN | 103924175 | A | 7/2014 |
| CN | 105525162 | A | 4/2016 |
| CN | 107475648 | A | 12/2017 |
| EP | 0 558 957 | A2 | 9/1993 |
| EP | 0610006 | A1 | 8/1994 |
| EP | 0799900 | A1 | 10/1997 |
| EP | 1138794 | A1 | 10/2001 |
| EP | 2 241 644 | A1 | 10/2010 |
| JP | H02117704 | A | 5/1990 |
| JP | H05331587 | A | 12/1993 |
| JP | H11507102 | A | 6/1999 |
| JP | 2002105573 | A | 4/2002 |
| JP | 2004250738 | A | 9/2004 |
| JP | 2008-025006 | A | 2/2008 |
| WO | WO-03010349 | A1 | 2/2003 |
| WO | WO 2010/085888 | A1 | 8/2010 |
| WO | WO-2014088449 | A1 | 6/2014 |
| WO | WO-2015119021 | A1 | 8/2015 |

OTHER PUBLICATIONS

Extended European Search Report dated Sep. 21, 2020 for European Application No. 18763441.5, 8 pages.

Non-Final Office Action dated May 4, 2016 for U.S. Appl. No. 14/645,654, 8 pages.

Non-Final Office Action dated Dec. 31, 2018 for U.S. Appl. No. 15/263,011, 5 pages.

Final Office Action dated Aug. 8, 2019 for U.S. Appl. No. 15/263,011, 7 pages.

Ex Parte Quayle Office Action mailed Aug. 19, 2019 for U.S. Appl. No. 15/642,798, 5 pages.

Extended European Search Report dated Feb. 15, 2017 for European Application No. 15760733.4, 9 pages.

Extended European Search Report dated Sep. 23, 2019 for European Application No. 19172652.0, 8 pages.

International Search Report and Written Opinion dated Jun. 25, 2016 for International Application No. PCT/US2015/020218, 14 pages.

International Search Report and Written Opinion dated Jun. 15, 2018 for International Application No. PCT/US2018/020899, 10 pages.

Berezina, A. L. et al., "Decomposition Processes in the Anomalous Supersaturated Solid Solution of Binary and Ternary Aluminum Alloys Alloyed with Sc and Zr," Acta Physica Polonica A, 122(3):539-543 (2011).

Booth-Morrison, C. et al., "Effect of Er additions on ambient and high-temperature strength of precipitation-strengthened Al—Zr—Sc—Si alloys," Acta Mater, 60:3463-3654 (2012).

Booth-Morrison, C. et al., "Role of silicon in accelerating the nucleation of $Al_3$(Sc,Zr) precipitates in dilute Al—Sc—Zr alloys," Acta Mater, 60:4740-4752 (2012).

Booth-Morrison, C. et al., "Coarsening resistance at 400° C of precipitation-strengthened AlZrScEr Alloys," Acta Mater, 59(18):7029-7042 (2011).

Carroll, M. C. et al., "Effects of minor Cu additions on a Zn-modified Al-5083 alloy," Materials Science and Engineering, A319-321:425-428 (2001).

Carroll, M. C. et al., "Effects of Zn Additions on the Grain Boundary Precipitation and Corrosion of Al-5083," Spripta Mater., 42:335-340 (2000).

Carroll, M. C. et al., "Optimum Trace Copper Levels for SCC Resistance in a Zn-Modified Al-5083 Alloy," Materials Science Forum, 396-402:1443-1448 (2002).

Fuller, C. B. et al., "Temporal evolution of the nanostructure of Al(Sc,Zr) alloys: Part 1—Chemical compositions of $Al_3(Sc_{1-x}Zr_x)$ precipitates," Acta Mater, 53:5401-5413 (2005).

Hallem, H. et al., "The formation of $Al_3(Sc_xZryHf_{1-x-y})$ dispersoids in aluminum alloys," Mater Sci Eng A, 421:154-160 (2006).

Hori, S et al., "Effect of small addition of Si on the precipitation of Al—0.6%Zr Alloys," J Jpn Inst Light Met, 28:79-84(1978).

Huang, H. et al., "Age Hardening Behavior and Corresponding Microstructure of Dilute Al—Er—Zr Alloys," Metallurgical and Materials Transactions A, 44A:2849-2856 (2013).

Knipling, K. E. et al., "Criteria for developing castable, creep-resistant aluminum-based alloys—a Review," Z Metallkd, 97:246-265 (2006).

Knipling, K. E. et al., "Atom Probe Tomographic Studies of Precipitation in Al—0.1Zr—0.1Ti (at.%) Alloys," Microscopy and Microanalysis, 13:1-14 (2007).

Knipling, K. E. et al., "Nucleation and Precipitation Strengthening in Dilute Al—Ti and Al—Zr Alloys," Metallurgical and Materials Transactions A, 38A:2552-2563 (2007).

Knipling, K. E. et al., "Creep resistance of cast and aged Al—0.1 Zr and Al—0.1Zr—0.1Ti (at.%) alloys at 300-400° C," Scrpta Materialia, 59:387-390 (2008).

Knipling, K. E. et al., "Precipitation evolution in Al—Zr and Al—Zr—Ti alloys during isothermal aging at 375-425° C," Acta Mater, 56:114-127 (2008).

Knipling, K. E. et al., "Precipitation evolution in Al—Zr and Al—Zr—Ti alloys during isothermal aging at 450-600° C," Acta Mater, 56:1182-1195 (2008).

Knipling, K. E. et al., "Precipitation evolution in Al—0.1Sc, Al—0.1 Zr and Al—0.1Sc—0.1Zr (at.%) alloys during isochronal aging," Acta Mater, 58:5184-5195 (2010).

Knipling, K. E. et al., "Ambient- and high-temperature mechanical properties of isochronally aged Al—0.06Sc, Al—0.06Zr and Al—0.06Sc—0.06Zr (at.%) alloys," Acta Mater, 59:943-954 (2011).

Kumar, N. et al., "Microstructure and mechanical behavior of friction stir processed ultrafine grained Al—Mg—Sc alloy," Materials Science and Engineering A, 528:5883-5887 (2011).

Kumar, N. et al., "Critical grain size for change in deformation behavior in ultrafine grained Al—Mg—Sc alloy," Scr Mater, 64:576-579 (2011).

Kumar, N. & Mishra, R. S., "Thermal stability of friction stir processed ultrafine grained Al—Mg—Sc alloy," Materials Characterization, 74:1-10 (2012).

LeClaire, A. D. et al., "3.2.13 Aluminum group metals," Diffusion in Solid Metals and Alloys (H. Mehrer (Ed.)), Springer Materials—Landolt-Börnstein—Group III condensed Matter, 26:151-156 (1990).

Li, H. et al., "Precipitation and evolution and coarsening resistance at 400° C of Al microalloyed with Zr and Er," Scr Mater, 67:73-76 (2012).

Ohashi, T. et al., "Effect of Fe and Si on age hardening properties of supersaturated solid solution of Al—Zr," J Jpn. Inst Met, 34:604-640 (1970).

Riddle, Y. W. et al., "A Study of Coarsening, Recrystallization, and Morphology of Microstructure in Al—Sc—(Zr)—(Mg) Alloys," Metallurgical and Materials Transactions A, 35A:341-350 (2004).

Sato, T. et al., "Effects of Si and Ti Additions on the Nucleation and Phase Stability of the $L1_2$-Type $Al_3Zr$ Phase in Al—Zr Alloys," Mater Sci Forum, 217-222:895-900 (1996).

(56) References Cited

OTHER PUBLICATIONS

Seidman, D. N. et al., "Precipitation strengthening at ambient and elevated temperatures of heat-treatable Al(Sc) alloys," Acta Mater, 50:4021-4035 (2002).
Unocic, K. A. et al., "Grain Boundary Precipitate Modification for Improved Intergranular Corrosion Resistance," Materials Science Forum, 519-521:327-332 (2006).
Van Dalen, M. E. et al., "Effects of Ti additions on the nanostructure and creep properties of precipitation-strengthened Al—Sc alloys," Acta Mater, 53:4225-4235 (2005).
Wen, S. P. et al., "Synergetic effect of Er and Zr on the precipitation hardening of Al—Er—Zr alloy," Scr Mater, 65:592-595 (2011).
Zhang, Y. et al., "Precipitation evolution of Al—Zr—Yb alloys during isochronal aging," Scr Mater, 69:477-480 (2013).
Court, S. A. et al., "The Ageing and Thermal Recovery Behaviour of Al—Mg—Cu Alloys," Materials Science Forum, vols. 396-402, pp. 1031-1036, 2002. doi:10.4028/www.scientific.net/MSF.396-402.1031.
Final Office Action dated Feb. 24, 2021 for U.S. Appl. No. 15/263,011, 7 pages.
Furu, T. et al., "Trace Elements in Aluminium Alloys:Their Origin and Impact on Processability and Product Properties," Proceedings of the 12th International Conference on Aluminium Alloys, Sep. 5-9, 2010, Yokohama, Japan, pp. 282-289, 2010.
International Search Report and Written Opinion dated Oct. 5, 2021 for International Application No. PCT/US2021/030676, 27 pages.
Morishita, M. et al., "Prediction method of crack sensitivity during DC casting of Al—Mn and Al—Mg series aluminum alloys," Journal of Japan Institute of Light Metals, vol. 59, No. 8, 2009, pp. 417-423. Abstract.
Nisancioglu, K., "Significance of Trace Element Segregation in Corrosion of Aluminum Alloys," Proceedings of the 12th International Conference on Aluminium Alloys, Sep. 5-9, 2010, Yokohama, Japan, pp. 1455-1462, 2010.
Non-Final Office Action dated Dec. 21, 2021 for U.S. Appl. No. 15/263,011, 7 pages.
Notice of Reasons for Rejection dated Feb. 1, 2022 for Japanese Application No. 2019-548274, with English translation, 11 pages.
Notice of Reasons for Rejection dated Nov. 8, 2022 for Japanese Application No. 2019-548274, with English translation, 7 pages.
Office Action dated Aug. 13, 2021 for Korean Application No. 10-2016-7028392, with English translation, 14 pages.
Office Action dated Dec. 15, 2020 for Chinese Application No. 201880025144.9, with English translation, 24 pages.
Office Action dated Sep. 9, 2021 for Chinese Application No. 201880025144.9, with English translation, 7 pages.
Zhu, Z. & Starink, M. J., "Age hardening and softening in cold-rolled Al—Mg—Mn alloys with up to 0.4 wt% Cu," Materials Science and Engineering A, 489:138-149 (2008).

HIGH-PERFORMANCE 5000-SERIES ALUMINUM ALLOYS

This application is a continuation of International Patent Application No. PCT/US2018/020899, filed Mar. 5, 2018, and titled High-Performance 5000-Series Aluminum Alloys, which claims the benefit of and priority to U.S. Provisional Patent Application No. 62/468,467, filed Mar. 8, 2017, and titled High-Performance 5000-Series Aluminum Alloys, the contents of each of which are incorporated herein by reference in their entirety. This invention was made with government support under Federal Award No. IIP 1549282, awarded by National Science Foundation. The Government has certain rights in the invention.

This invention was made with government support under Federal Award No. IIP 1549282, awarded by National Science Foundation. The Government has certain rights in the invention.

FIELD

This application relates to a family of 5000-series aluminum alloys with high strength, good ductility, high creep resistance, high thermal stability and durability. The disclosed alloys are especially advantageous for, but not limited to, improving performance of beverage can lids and tabs. Additionally, the disclosed alloys are, for example, advantageous for improving performance of roofing and siding materials, chemical and food equipment, storage tanks, home appliances, sheet-metal work, marine parts, transportation parts, heavy duty cooking utensils, hydraulic tubes, fuel tanks, pressure vessels, heavy-duty truck and trailer bodies and assemblies, drilling rigs, missile components, and railroad cars.

BACKGROUND

The production of aluminum cans, largely to store beverages, is the single largest usage of aluminum in the world. The annual production is a staggering 320 billion cans per year, equating to 4.16 billion kilograms of aluminum. In addition, aluminum canning is likely the world's best example of recycling, as 75% of the aluminum used in cans is recycled. The production of aluminum cans is enormous, so an efficiency improvement comes with a giant multiplicative effect; a single gram of weight saved in the can may save over 200 thousand metric tons of aluminum globally per year. Together with this weight benefit, the energy consumption as well as the $CO_2$ emissions during transport are reduced—both key metrics in sustainability of the environment. Additionally, the lightness of aluminum cans helps save resources during filling, storage, transportation and scrap at the end of the product's life. Thus lightweighting the can has been a front-burner issue for decades.

The beverage packaging industry is constantly seeking ways to maintain the can's performance while continuing to trim the materials as much as possible. A common can design consists of two pieces: the can body is made of 3000-series aluminum, specifically AA3004, while the can lid and opener are made from 5000-series aluminum, specifically AA5182. The success behind the consistent and precise production of aluminum cans is based on the strong yet formable 3000- and 5000-series aluminum sheets. The can body is about 75% of the can's mass, while the smaller lid claims the rest, 25%. Two most obvious ways to design a lighter can are: (i) designing a smaller lid and (ii) reducing thickness of the can's wall and lid. To thin the can body and lid, stronger 3000-series and 5000-series alloys are needed, while maintaining important characteristics, such as density, formability and corrosion resistance. Aerospace-grade 2000- and 7000-series are very strong, but their low formability is not suitable for canning. Thus the common approach to develop new canning materials is to modify the currently utilized alloys, that is, modifying alloy composition and thermo-mechanical processes to the current 3000-series and 5000-series alloys to strengthen them without sacrificing other important properties. Moreover, 75% of the aluminum in cans is recycled and is currently being used to recast aluminum sheets, which are returned to can manufacturers to produce new batches of cans. Recycling plays a significant role in the economics of canning, thus modifying the current 3000-series and 5000-series alloys will help maintain the usage of low-cost recycled cans.

A well-known means to enhance the strength and maintain the ductility of commercial aluminum alloys is the addition of small concentrations of Scandium (Sc). The strengthening originates from the creation during aging of $L1_2$-structured $Al_3Sc$ nano-precipitates (~5-10 nm in diam.) which are coherent with the aluminum matrix. The small volume fraction, nano-size and matrix coherency of these precipitates help the alloys maintain other properties, such as ductility and formability. Scandium, however, is extremely costly (ten-fold more expensive than silver), severely prohibiting its usage in cost-sensitive applications such as food and drink packaging.

Accordingly, stronger 5000-series aluminum alloys are needed, while maintaining important characteristics, such as density, formability and corrosion resistance. With a stronger material, the can's lid and tab can be made thinner, resulting in a lighter beverage can. In addition, higher performance 5000-series aluminum alloys are needed constantly in many other applications for lightweighting purposes.

SUMMARY

The embodiments described herein relate to heat-treatable aluminum-magnesium-based (5000-series) alloys, containing an $Al_3Zr$ nanoscale precipitate, wherein the nanoscale precipitate has an average diameter of about 20 nm or less and has an $L1_2$ structure in an α-Al face centered cubic matrix, wherein the average number density of the nanoscale precipitate is about $20^{21}$ $m^{-3}$ or more. They exhibit high strength, good ductility, high creep resistance, high thermal stability and durability, while being essentially free of scandium (i.e., no scandium is added intentionally).

% (AA5182+Zr+Zn) (invented alloy). Error bars are omitted for a few data points for the sake of figure clarity.

Figure 4:
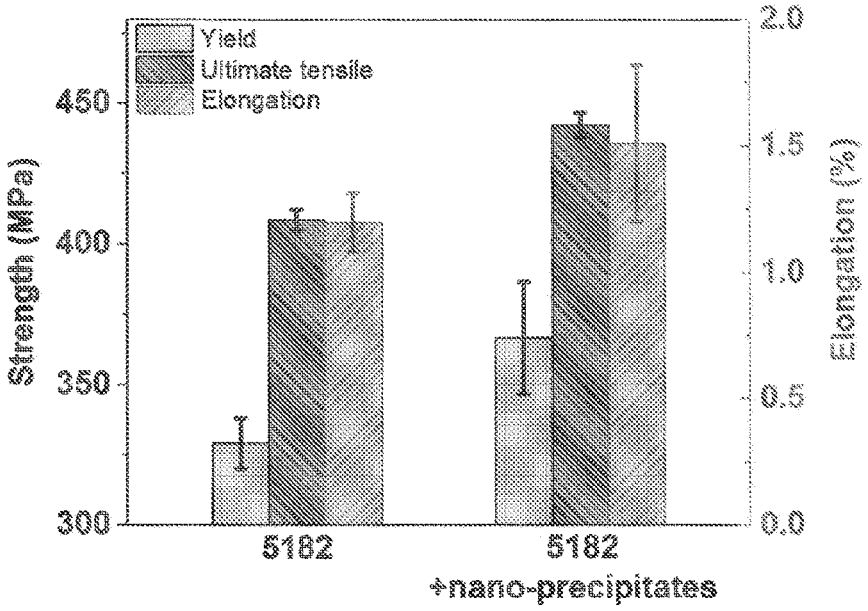

FIG. 4: Mechanical properties of Al-4.5Mg-0.35Mn-0.2Si wt. % (AA5182) and Al-4.5Mg-0.35Mn-0.2Si-0.3Zr-0.1Sn wt. % (AA5182+nano-precipitates) (invented alloy), after peak-aging and cold-rolling.

Figure 5:
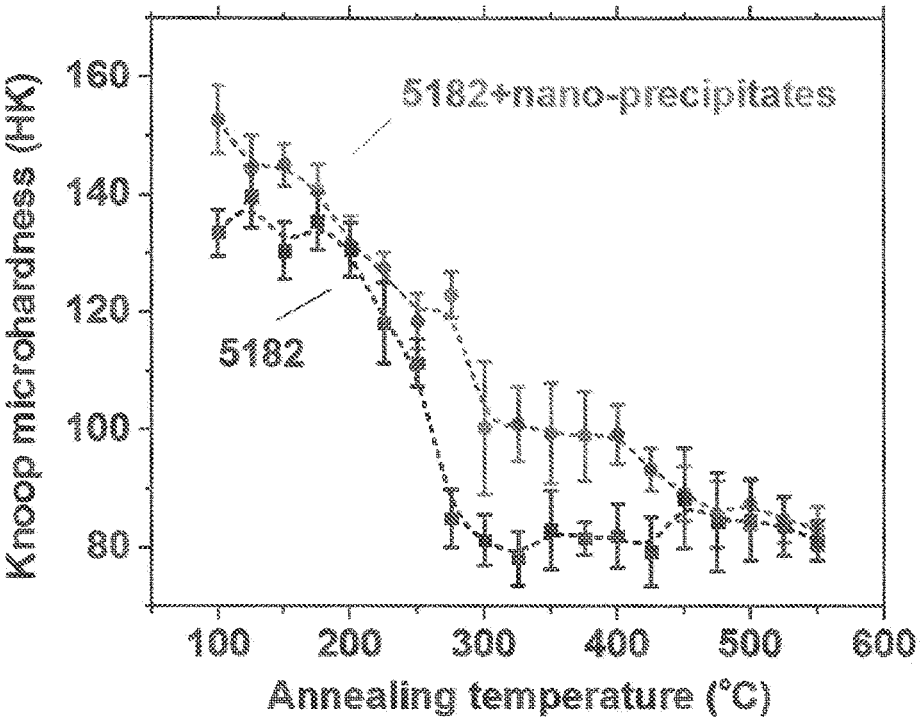

FIG. 5: Microhardness of cold rolled Al-4.5Mg-0.35Mn-0.2Si wt. % (AA5182) and Al-4.5Mg-0.35Mn-0.2Si-0.3Zr-0.1Sn wt. % (AA5182+nano-precipitates) (invented alloy) versus annealing temperature (1 h at each temperature).

Figure 1A:
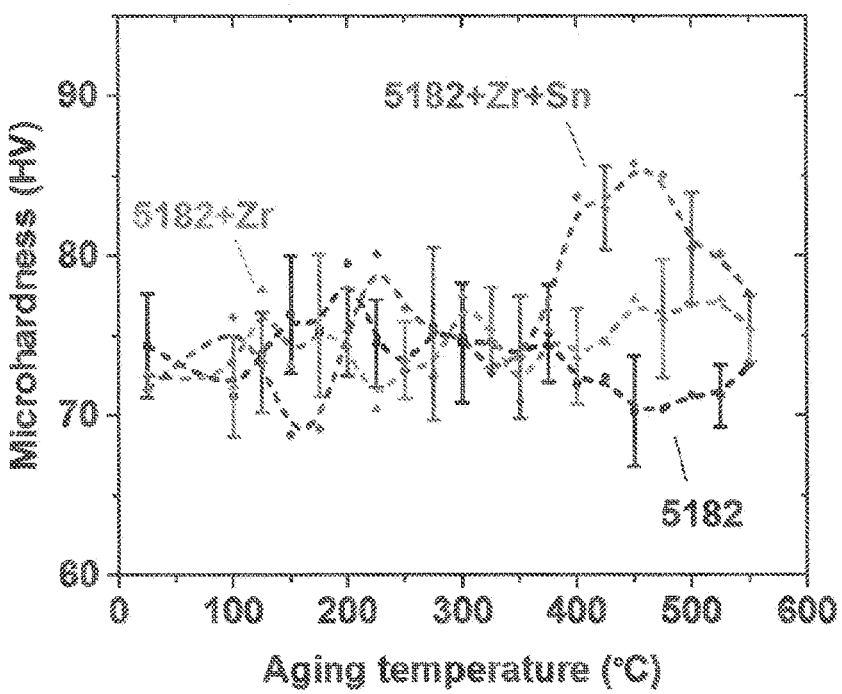
FIGS. 1A and 1B: Microhardness evolution during (A) isochronal and (B) isothermal aging at 400° C. of Al-4.5Mg-0.35Mn-0.2Si wt. % (AA5182), Al-4.5Mg-0.35Mn-0.3Zr wt. % (AA5182+Zr) and Al-4.5Mg-0.35Mn-0.2Si-0.3Zr-0.1Sn wt. % (AA5182+Zr+Sn) (invented alloy). Error bars are omitted for a few data points for the sake of figure clarity.
Figure 1B:
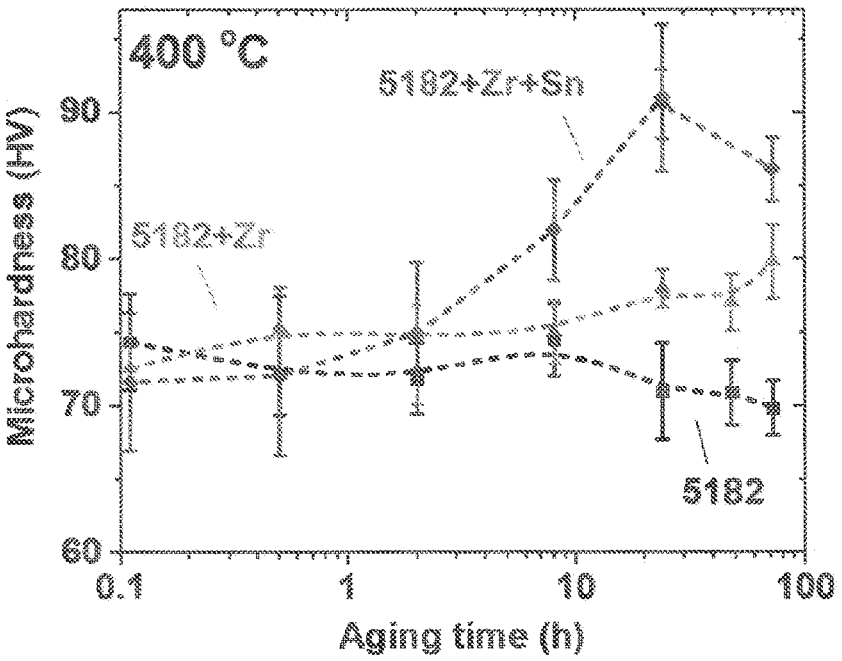
Figure 2A:
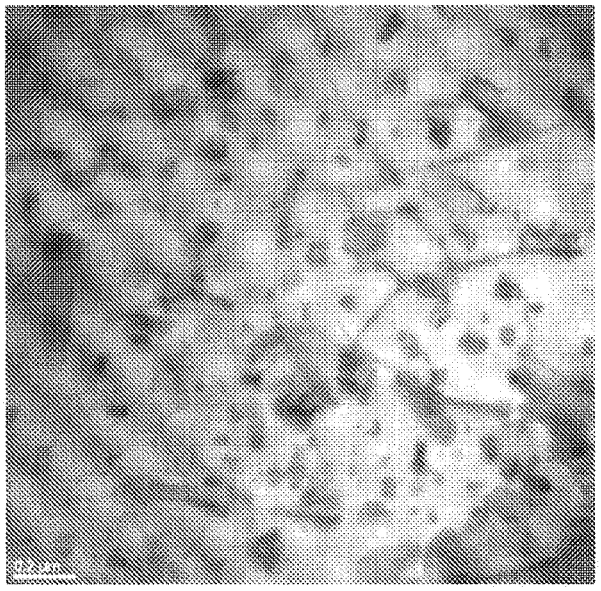
FIGS. 2A and 2B: (A) Bright field, two-beam transmission electron microscopy of Al-4.5Mg-0.35Mn-0.2Si-0.3Zr-0.1Sn wt. % (invented alloy), and (B) higher magnification view, displaying the existence of $Al_3Zr$ nano-precipitates (circles).
Figure 2B:
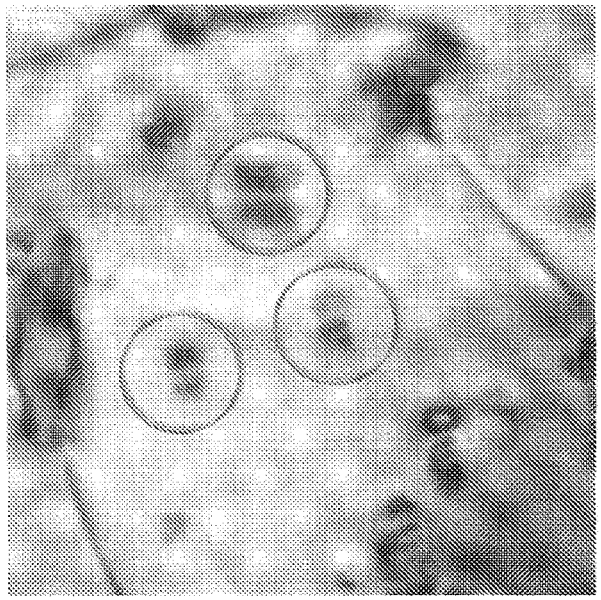

DETAILED DESCRIPTION 5000-series aluminum alloys are strain-hardenable but not heat-treatable. They contain magnesium as the main alloying element, optionally with manganese, and typically have good strength, formability, and corrosion resistance. AA5182 aluminum alloy, containing 4-5Mg and 0.2-0.5Mn (wt. %), is currently being utilized for beverage can lids. It also is being used in automotive applications. The effect of $Al_3Zr$ nano-precipitates on the mechanical performance of this alloy was investigated. FIG. 1A displays the microhardness evolution during isochronal aging of Al-4.5Mg-0.35Mn-0.2Si wt. % (AA5182, example alloy), Al-4.5Mg-0.35Mn-0.3Zr wt. % and Al-4.5Mg-0.35Mn-0.2Si-0.3Zr-0.1Sn wt. % (invented alloy). AA5182 is not heat-treatable, thus its microhardness evolution is unchanged at all temperatures. With an addition of 0.3% Zr, the microhardness evolution also appears unchanged at all temperatures. There is a slight increase in microhardness from 400 to 550° C., compared to the based AA5182 alloy, but this is within experimental error. With the addition of 0.3Zr+0.1Sn wt. %, a peak-microhardness of 86±3 HV (a 23% increase) was observed at 450° C., compared to 70±4 HV in the based AA5182 alloy. This is a strong indication of $Al_3Zr$ nano-precipitates, which are known to form around this temperature and enhance strength. This is corroborated by the microhardness evolution during isothermal at 400° C., as shown in FIG. 1B, of these three alloys. Microhardness of the base AA5182 alloy is unchanged, while it starts to increase after aging for 24 h with addition of Zr. In the Al-4.5Mg-0.35Mn-0.2Si-0.3Zr-0.1Sn wt. % invented alloy, it increases rapidly during aging and peaks at 24 h, reaching ~90±5 KV (a 29% increase), compared to 70±5 HV in the based AA5182 alloy. It should be noted that an addition of only Zr, without an inoculant (Sn), is not sufficient to generate a high number density of $Al_3Zr$ nano-precipitates, hence the strength increase due to Zr addition, without Sn, is not significant. The precipitate structure of the peak-aged Al-4.5Mg-0.35Mn-0.2Si-0.3Zr-0.1Sn wt. % invented alloy is displayed in FIGS. 2A and 2B. Three different populations of precipitates, $Al_6Mn$, hexagonal α-Al(Mn, Fe)Si, and $Al_3Zr$ nano-precipitates, are observed. Fe is present in the alloy as an impurity element. The first two populations appear in a low number density, whereas a high number density of $Al_3Zr$ nano-precipitates is observed.

Figure 3:
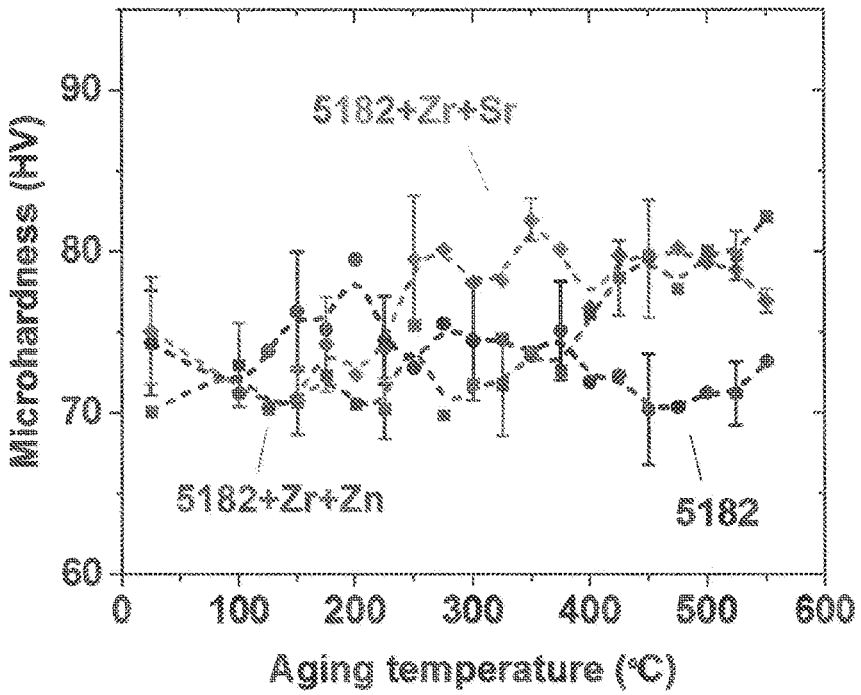
FIG. 3: Microhardness evolution during isochronal aging of Al-4.5Mg-0.35Mn-0.2Si wt. % (AA5182), Al-4.5Mg-0.35Mn-0.2Si-0.3Zr-0.003Sr wt. % (AA5182+Zr+Sr) (invented alloy) and Al-4.5Mg-0.35Mn-0.2Si-0.3Zr-0.5Zn wt.

FIG. 3 displays the microhardness evolution during isochronal aging of Al-4.5Mg-0.35Mn-0.2Si wt. % (AA5182), Al-4.5Mg-0.35Mn-0.2Si-0.3Zr-0.003Sr wt. % (invented alloy) and Al-4.5Mg-0.35Mn-0.2Si-0.3Zr-0.5Zn wt. % (invented alloy). With an addition of 0.3Zr+0.003Sr wt. %, there is a significant increase in microhardness from 250 to 500° C., reaching 82±4 HV (a 19% increase), compared to the based AA5182 alloy. With an addition of 0.3Zr+0.5Zn wt. %, there is also a significant increase in microhardness from 400 to 550° C., reaching 82±3 HV (a 19% increase), compared to the based AA5182 alloy. This is a strong indication of the formation of $Al_3Zr$ nano-precipitates, assisted by either Sr or Zn, which enhances strength.

Mechanical properties of Al-4.5Mg-0.35Mn-0.2Si wt. % (AA5182) and Al-4.5Mg-0.35Mn-0.2Si-0.3Zr-0.1Sn wt. % (invented alloy), after peak-aging and cold rolling are displayed in FIG. 4. Both strength and elongation of the AA5182, with addition of nano-precipitates, are increased compared to the based AA5182 alloy. An increase of 12% in yield strength, 8% in tensile strength, and 26% in elongation are observed.

Additionally, FIG. 5 suggests that the recrystallization temperature is at ~250° C. for cold-rolled Al-4.5Mg-0.35Mn-0.2Si wt. % (AA5182) and at ~300° C. for cold-rolled Al-4.5Mg-0.35Mn-0.2Si-0.3Zr-0.1Sn wt. % (invented alloy), containing nano-precipitates (an increase of 50° C.). This suggests that $Al_3Zr$ nano-precipitates suppresses the recrystallization, by pinning the movement of grain boundaries via Zener pinning.

Table 1 lists mechanical properties of thin sheets (0.25 mm in thickness) of Al-4.5Mg-0.25Mn-0.2Fe-0.09Si wt. % (AA5182) in hard-temper (example alloy 1) and soft temper (example alloy 2), Al-4.5Mg-0.25Mn-0.2Fe-0.09Si-0.3Zr-0.1Sn wt. % (AA5182-nano) in hard-temper (invented alloy 1) and soft temper (invented alloy 2). AA5182 hard-temper is a common aluminum alloy for beverage can lids, whereas AA5182 soft-temper is commonly used in automotive applications. The AA5182-nano alloy, in both hard- and soft-tempers (invented alloys 1 and 2) achieve higher yield strength and tensile strength, while maintaining essentially the same elongation at break, compared to the AA5182 alloy with the respective tempers (example alloy 1 and 2). The thin sheets of the alloys in Table 1 were fabricated by the following steps: casting, hot-rolling, annealing, cold-rolling, and stabilizing heat treatment for hard-temper; and casting, hot-rolling, cold rolling, and annealing for soft-temper.

TABLE 1

| | Yield strength (MPa) | Tensile strength (MPa) | Elongation at break (%) |
|---|---|---|---|
| AA5182 - hard temper (example alloy 1) | 355 ± 6 | 412 ± 7 | 6-8 |
| AA5182-nano - hard temper (invented alloy 1) | 390 ± 6 | 450 ± 8 | 6-8 |
| AA51.82 - soft temper (example alloy 2) | 170 ± 5 | 315 ± 6 | 20-25 |
| AA5182-nano - soft, temper (invented alloy 2) | 200 ± 4 | 330 ± 7 | 20-25 |

The disclosed aluminum alloys are essentially free of scandium, which is understood to mean that no scandium is added intentionally. Addition of scandium in aluminum alloys is advantageous for mechanical properties. For example, it is described in U.S. Pat. No. 5,624,632, which is incorporated herein by reference. However, scandium is very expensive (ten times more expensive than silver), severely limiting its practical applications.

Zirconium, with a concentration of up to about 0.3 wt. %, is sometimes added to aluminum alloys for grain refining. The refined grain structure helps improve castability, ductility, and workability of the final product. An example is described in U.S. Pat. No. 5,976,278, which is incorporated herein by reference. In the present application, zirconium with a concentration of less than about 0.5 wt. %, and preferably less than about 0.4 wt. %, is added together with an inoculant element to form $Al_3Zr$ nano-precipitates, wherein the nanoscale precipitate has an average diameter of about 20 nm or less and has an $L1_2$ structure in an α-Al face centered cubic matrix, and wherein the average number density of the nanoscale precipitate is about $20^{21}$ $m^{-3}$ or more, with a purpose to improve mechanical strength, ductility, creep resistance, thermal stability and durability of the based alloys. Generally, a zirconium concentration of more than about 0.2 wt. % is needed so that Zr atoms have enough driving force to form $Al_3Zr$ nano-precipitates.

Disclosed aluminum alloys comprise an inoculant, wherein the inoculant comprises one or more of tin, strontium, zinc, gallium, germanium, arsenic, indium, antimony, lead, and bismuth. The presence of an inoculant accelerates precipitation kinetics of $Al_3Zr$ nano-precipitates, thus these precipitates can be formed within a practical amount of time during heat-treatment. In the other words, the beneficial $Al_3Zr$ nano-precipitates can be formed within a few hours of heat treatment, with the presence of the inoculant, compared to between a few weeks and a few months of heat treatment without the presence of an inoculant. Among all inoculant elements, tin appears to be the best performer in terms of accelerating precipitation kinetics of $Al_3Zr$ nano-precipitates. A tin concentration of less than about 0.2% is needed for the mentioned purpose. Beyond this value, tin will form bubbles and/or a liquid phase in the aluminum solid matrix, which is detrimental for the mechanical properties. For example, this behavior is described in U.S. Pat. No. 9,453,272, which is incorporated herein by reference.

In one embodiment, an aluminum alloy comprises aluminum, magnesium, manganese, silicon, zirconium, and an inoculant, and including a nanoscale precipitate comprising $Al_3Zr$, wherein the nanoscale precipitate has an average diameter of about 20 nm or less and has an $L1_2$ structure in an α-Al face centered cubic matrix, wherein the average number density of the nanoscale precipitate is about $20^{21}$ $m^{-3}$ or more, and wherein the inoculant comprises one or more of tin, strontium, and zinc.

In one embodiment, if an aluminum alloy is in hard temper it possesses a yield strength of at least about 380 MPa, a tensile strength of at least about 440 MPa, and an elongation at least about 5% at room temperature.

In one embodiment, if an aluminum alloy is in soft temper it possesses a yield strength of at least about 190 MPa, a tensile strength of at least about 320 MPa, and an elongation of at least about 18% at room temperature.

In one embodiment, an aluminum alloy possesses a recrystallization temperature of about 300° C.

In one embodiment, an aluminum alloy comprises about 3.0 to about 6.2% by weight magnesium; about 0.01 to about 1.8% by weight manganese; about 0.01 to about 0.2% by weight silicon; about 0.2 to about 0.5% by weight zirconium; about 0.01 to about 0.2% by weight tin; and aluminum as the remainder.

In one embodiment, an aluminum alloy comprises about 3.0 to about 6.2% by weight magnesium; about 0.01 to about 1.8% by weight manganese; about 0.01 to about 0.2% by weight silicon; about 0.2 to about 0.5% by weight zirconium; about 0.001 to about 0.1% by weight strontium; and aluminum as the remainder.

In one embodiment, an aluminum alloy comprises about 3.0 to about 6.2% by weight magnesium; about 0.01 to 1.8% by weight manganese; about 0.01 to about 0.2% by weight silicon; about 0.2 to about 0.5% by weight zirconium; about 0.1 to about 1% by weight zinc; and aluminum as the remainder.

In one embodiment, an aluminum alloy comprises a plurality of $L1_2$ precipitates having an average diameter of about 10 nm or less.

In one embodiment, an aluminum alloy comprises a plurality of $L1_2$ precipitates having an average diameter of about 3 nm to about 7 nm.

In one embodiment, an aluminum alloy comprises about 4.5% by weight magnesium, about 0.35% by weight Manganese, about 0.2% by weight silicon, about 0.3% by weight zirconium, about 0.1% by weight tin, and aluminum as the remainder.

In one embodiment, an aluminum alloy comprises about 4.5% by weight magnesium, about 0.35% by weight manganese, about 0.2% by weight silicon, about 0.3% by weight zirconium, about 0.003% by weight strontium, and aluminum as the remainder.

In one embodiment, an aluminum alloy comprises about 4.5% by weight magnesium, about 0.35% by weight manganese, about 0.2% by weight silicon, about 0.3% by weight zirconium, about 0.5% by weight zinc, and aluminum as the remainder.

In one embodiment, an aluminum alloy comprises no more than about 0.5% iron as an impurity element.

In one embodiment, an aluminum alloy comprises aluminum, magnesium, manganese, silicon, zirconium, and an inoculant, and including a nanoscale precipitate comprising $Al_3Zr$, wherein the nanoscale precipitate has an average diameter of about 20 nm or less and has an $L1_2$ structure in an α-Al face centered cubic matrix, wherein the average number density of the nanoscale precipitate is about $20^{21}$ $m^{-3}$ or more, and wherein the inoculant comprises one or more of gallium, germanium, arsenic, indium, antimony, lead, and bismuth.

One method for manufacturing a component from a disclosed aluminum alloy comprises: a) melting the alloy at a temperature of about 700 to about 900° C.; b) then casting the melted alloy into casting molds at ambient temperature; c) then using a cooling medium to cool the cast ingot; and d) then heat aging the cast ingot at a temperature of about 350° C. to about 450° C. for a time of about 2 to about 48 hours. In one embodiment, the method further comprises cold rolling the cast ingot to form a sheet product. In one embodiment, the method further comprises a final stabilizing heat treatment of the sheet product at a temperature of about 140° C. to about 170° C. for a time of about 1 to about 5 hours. In some embodiments, the cooling medium can be air, water, ice, or dry ice. The heat aging step stated above (350-450° C. for 2-48 hours) is determined to be peak-aging for components comprising the disclosed aluminum alloys. When a component manufactured from a disclosed aluminum alloy is peak-aged, the microstructure of the component is thermally stable and is unchanged by exposure to elevated temperatures for extended times.

Another method for manufacturing a component from a disclosed aluminum alloy comprises: a) melting the alloy at a temperature of about 700 to 900° C.; b) then casting the alloy into casting molds at ambient temperature; c) then using a cooling medium to cool the cast ingot; and d) then hot rolling the cast ingot into a sheet. In one embodiment, the method further comprises then heat aging the sheet at a temperature of about 350° C. to about 450° C. for a time of about 2 to about 48 hours. In one embodiment, the method further comprises then cold rolling the sheet, after the heat aging step, to form a thin sheet or foil product. In one embodiment, the method further comprises a final stabilizing heat treatment of the thin sheet or foil product at a temperature of about 140° C. to about 170° C. for a time of about 1 to about 5 hours.

Another method for manufacturing a component from a disclosed aluminum alloy comprises: a) melting the alloy at a temperature of about 700 to 900° C.; b) then casting the alloy into casting molds at ambient temperature; c) then using a cooling medium to cool the cast ingot; d) then hot rolling the cast ingot into a sheet; e) then cold rolling the sheet to form a thin sheet or foil product; and f) then heat aging the thin sheet or foil product at a temperature of about 300° C. to about 410° C. for a time of about 2 to about 24 hours.

Some applications for the disclosed alloys include, for example, beverage can lids, beverage can tabs, roofing materials, siding materials, chemical manufacturing equipment, food manufacturing equipment, storage tanks, home appliances, sheet-metal work, marine parts, transportation parts, heavy duty cooking utensils, hydraulic tubes, fuel tanks, pressure vessels, truck bodies, truck assemblies, trailer bodies, trailer assemblies, drilling rigs, missile components, and railroad cars. Some fabricated forms of the disclosed aluminum alloys include, for example, wires, sheets, plates and foils.

From the foregoing, it will be understood that numerous modifications and variations can be effectuated without departing from the true spirit and scope of the novel concepts of the present invention. It is to be understood that no limitation with respect to the specific embodiments illustrated and described is intended or should be inferred.

The invention claimed is:

1. An aluminum alloy comprising:
3.0 to 6.2% by weight magnesium;
0.01 to 1.8% by weight manganese;
0.01 to 0.2% by weight silicon;
0.2 to 0.5% by weight zirconium;
an inoculant, wherein the inoculant is:
(a) 0.01 to 0.2% by weight tin; or
(b) 0.001 to 0.1 by weight strontium; and
aluminum as the remainder;
wherein the alloy includes a nanoscale precipitate comprising $Al_3Zr$;
wherein the nanoscale precipitate has an average diameter of about 20 nm or less and has an $L1_2$ structure in an α-Al face centered cubic matrix; and
wherein the average number density of the nanoscale precipitate is about $10^{21}$ $m^{-3}$ or more.

2. The aluminum alloy of claim 1, comprising:
about 3.0 to about 6.2% by weight magnesium;
about 0.01 to about 1.8% by weight manganese;
about 0.01 to about 0.2% by weight silicon;
about 0.2 to about 0.5% by weight zirconium;
about 0.01 to about 0.2% by weight tin; and
aluminum as the remainder.

3. The aluminum alloy of claim 1, comprising:
about 3.0 to about 6.2% by weight magnesium;
about 0.01 to about 1.8% by weight manganese;
about 0.01 to about 0.2% by weight silicon;
about 0.2 to about 0.5% by weight zirconium;
about 0.001 to about 0.1% by weight strontium; and
aluminum as the remainder.

4. The aluminum alloy of claim 1, wherein the plurality of $L1_2$ precipitates has an average diameter of about 10 nm or less.

5. The aluminum alloy of claim 1, wherein the plurality of $L1_2$ precipitates has an average diameter of about 3 nm to about 7 nm.

6. The aluminum alloy of claim 1, comprising:
about 4.5% by weight magnesium;
about 0.35% by weight manganese;
about 0.2% by weight silicon;
about 0.3% by weight zirconium;
about 0.1% by weight tin; and
aluminum as the remainder.

7. The aluminum alloy of claim 1, comprising:
about 4.5% by weight magnesium;
about 0.25% by weight manganese;
about 0.09% by weight silicon;
about 0.2% by weight iron;
about 0.3% by weight zirconium;
about 0.1% by weight tin; and
aluminum as the remainder.

8. The aluminum alloy of claim 1, comprising:
about 4.5% by weight magnesium;
about 0.35% by weight manganese;
about 0.2% by weight silicon;
about 0.3% by weight zirconium;
about 0.003% by weight strontium; and
aluminum as the remainder.

9. The aluminum alloy of claim 1, comprising:
about 4.5% by weight magnesium;
about 0.35% by weight manganese;
about 0.2% by weight silicon;
about 0.3% by weight zirconium;
about 0.5% by weight zinc; and
aluminum as the remainder.

10. The aluminum alloy of claim 1, wherein the alloy possesses a recrystallization temperature of about 300° C.

11. The aluminum alloy of claim 1, wherein the alloy is essentially free of scandium.

12. The aluminum alloy of claim 1, wherein the alloy comprises no more than about 0.5% iron as an impurity.

13. A beverage can lid comprising the aluminum alloy of claim 1.

14. A beverage can tab comprising the aluminum alloy of claim 1.

15. An aluminum alloy component comprising the aluminum alloy of claim 1, wherein the aluminum alloy component is selected from a group consisting of roofing materials, siding materials, chemical manufacturing equipment, food manufacturing equipment, storage tanks, home appliances, sheet-metal work materials, marine parts, transportation parts, heavy duty cooking utensils, hydraulic tubes, fuel tanks, pressure vessels, truck bodies, truck assemblies, trailer bodies, trailer assemblies, drilling rigs, missile components, and railroad cars.

16. A fabricated form of the aluminum alloy of claim 1, the fabricated form selected from a group consisting of wires, sheets, plates and foils.

17. The aluminum alloy of claim 1, wherein when the aluminum alloy is in hard temper, it possesses a yield strength of at least about 380 MPa, a tensile strength of at least about 440 MPa, and an elongation of at least about 5% at room temperature; and when the aluminum alloy is in soft temper, it possesses a yield strength of at least about 190 MPa, a tensile strength of at least about 320 MPa, and an elongation of at least about 18% at room temperature.

* * * * *